US006189878B1

(12) United States Patent
Meese

(10) Patent No.: US 6,189,878 B1
(45) Date of Patent: Feb. 20, 2001

(54) CLAMP FOR WORKPIECES

(75) Inventor: Ludwig Meese, Bergisch Gladbach (DE)

(73) Assignee: Meese Spanntechnik GmbH (DE)

( * ) Notice: Under 35 U.S.C. 154(b), the term of this patent shall be extended for 0 days.

(21) Appl. No.: 09/367,301

(22) PCT Filed: Feb. 9, 1998

(86) PCT No.: PCT/DE98/00333

§ 371 Date: Oct. 12, 1999

§ 102(e) Date: Oct. 12, 1999

(87) PCT Pub. No.: WO98/34761

PCT Pub. Date: Aug. 13, 1998

(30) Foreign Application Priority Data

Feb. 10, 1997 (DE) ..... 197 04 912

(51) Int. Cl.[7] ..... B25B 1/24

(52) U.S. Cl. ..... 269/156; 269/231; 269/235; 269/258; 269/268

(58) Field of Search ..... 269/249, 156, 269/266, 268, 902, 217, 233, 305, 45, 910, 258, 231, 229, 235

(56) References Cited

U.S. PATENT DOCUMENTS

| | | | | |
|---|---|---|---|---|
| 1,349,963 | * | 8/1920 | Jerrim | 269/156 |
| 2,541,605 | * | 2/1951 | Ohlsson | 269/156 |
| 2,698,550 | * | 1/1955 | Hill | 269/156 |
| 3,603,580 | | 9/1971 | Van Gelder . | |
| 4,157,819 | | 6/1979 | Meyer . | |
| 4,767,110 | * | 8/1988 | Yang | 269/258 |
| 5,350,163 | * | 9/1994 | Lichtenberg | 269/258 |
| 5,556,085 | * | 9/1996 | Cyr | 269/258 |

FOREIGN PATENT DOCUMENTS

| | | |
|---|---|---|
| 2117678 | 10/1972 | (DE) . |
| 8897182 | 8/1986 | (DE) . |
| 0267982 | 11/1986 | (DE) . |
| 8800461 | 1/1988 | (DE) . |
| 4139260 | 3/1993 | (DE) . |
| 2486845 | 7/1980 | (FR) . |
| 2164877 | 9/1984 | (GB) . |
| 7611816 | 10/1976 | (NL) . |

OTHER PUBLICATIONS

Industrie–Anzieger, Mar. 18, 1960, No. 23, pp. 343–346.

* cited by examiner

*Primary Examiner*—Robert C. Watson
(74) *Attorney, Agent, or Firm*—Reising, Ethington, Barnes, Kisselle, Learman & McCulloch, P.C.

(57) ABSTRACT

A workpiece clamp is disclosed for pressing first and second workpieces into engagement by a chucking tool (6) and a counter-holding device (7) supported by a frame (5). A pair of clamping jaws (11,12) with spiral shaped clamping surfaces (13,14) are pivotally mounted on the clamping jaw support (8) of U-shape having two spaced apart support members. First and second pivot pins (21,22) are mounted opposite and parallel to each other on the support members. The clamping jaws squeeze and hold one workpiece therebetween when the chucking tool (6) is moved against the other workpiece to force the workpieces into engagement. The spaced apart support members provide a clearance space to allow one of the workpieces to be inserted between the jaws at any angle for engagement with the other workpiece.

16 Claims, 10 Drawing Sheets

Fig. 3
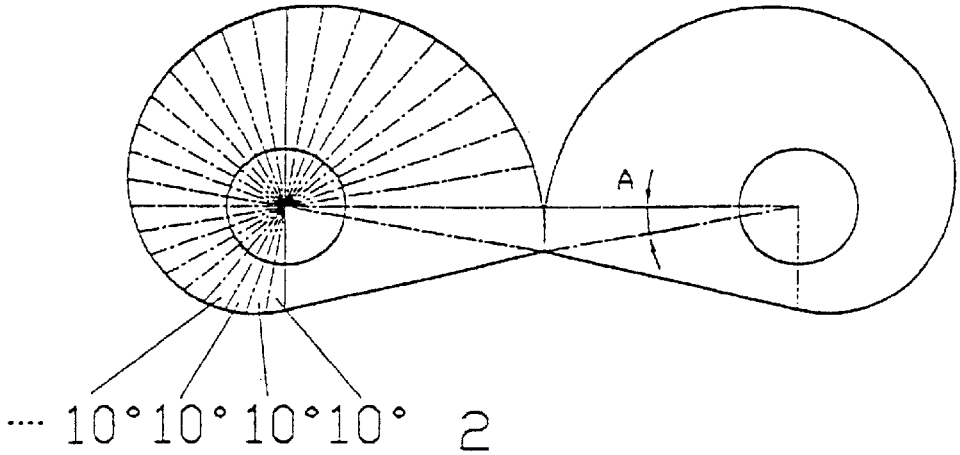
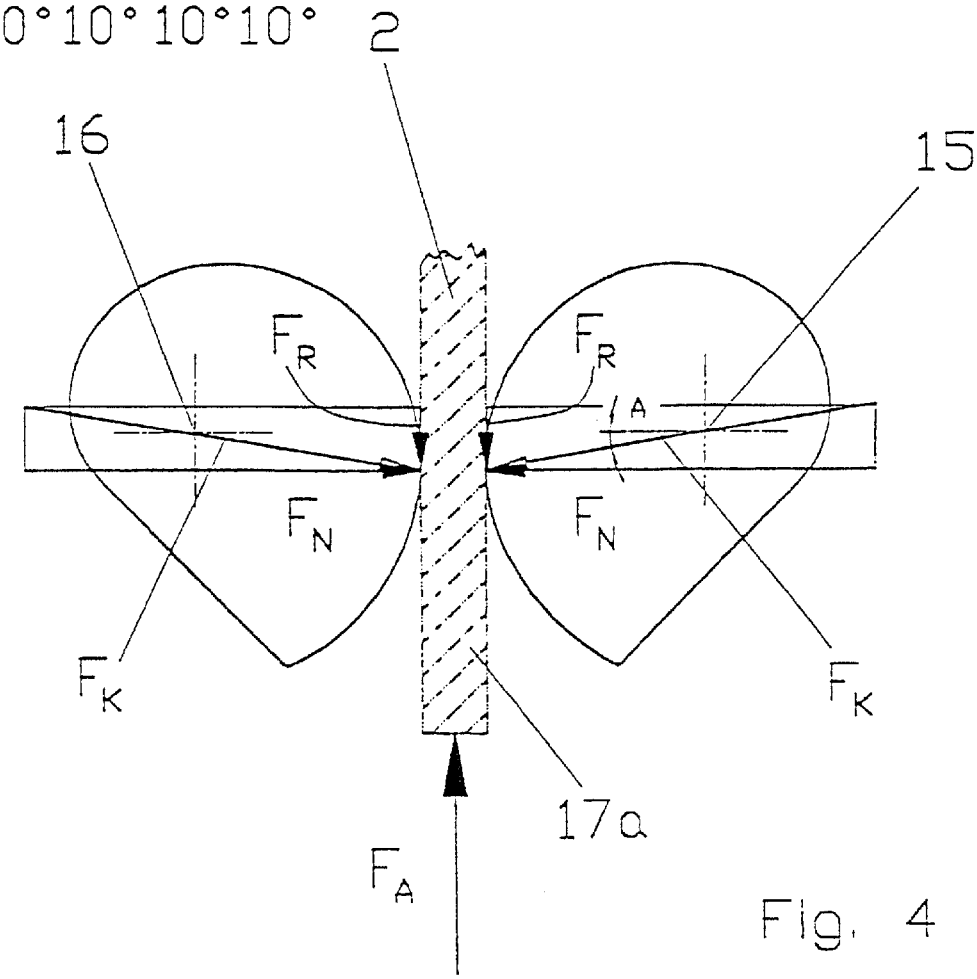
Fig. 4

CLAMP FOR WORKPIECES

FIELD OF THE INVENTION

This invention relates clamping devices; more particularly, it relates to a clamp for pressing a first extended plate-like or bar-shaped workpiece in its longitudinal direction against a bearing surface of a second workpiece.

BACKGROUND OF THE INVENTION

A workpiece is known from German utility model patent G 88 00 461.9, with which an edging strip can be mounted on the narrow, circumferential edge of a table-shaped workpiece. Clamping jaws are provided in a clamping jaw support known as a yoke. The yoke has forked legs. The clamping jaws are pivot-mounted about parallel axes through the forked ends of the legs of the yoke.

In this device the workpieces to be clamped the open space between the legs of the yoke.

Another workpiece clamp is disclosed in U.S. Pat. No. 5,350,163. It has clamping jaws which can be adjusted by sliding in guide grooves. These guide grooves are arranged on a clamping jaw support in symmetrical and V-shaped fashion relative to one another. When clamping a workpiece, the clamping jaws move in the direction of the tapering guide grooves. This results in a wedge effect, which primarily serves to clamp the workpiece. The V-shaped arrangement of the guide grooves makes it possible to use the to clamp a relatively wide range of workpiece thicknesses. However, this device is also limited to workpieces which can only extend freely on the side of the clamping jaw support on which the jaws are mounted.

The function of this device disadvantageously requires that the clamping jaws arranged in the symmetrical guide grooves be positioned exactly opposite one another when approaching a workpiece. If the clamping jaws are not exactly opposite one another, this leads to a situation where one of the clamping jaws moves in one direction in its guide groove and the opposite clamping jaw in the other direction, when pressing on the workpiece. This causes the workpiece to rotate and prevents it from being clamped. In order to be able to handle this clamp clip despite these difficulties, it is provided with an auxiliary device with which the clamping jaws can always be moved in the guide grooves in a symmetrical position relative to one another.

In order for the bearing pins of this device to always remain in a vertical position, the guide grooves and the bearing pins guided in them must be manufactured with great precision. Any play in the bearing pin caused by wear quickly makes the device unserviceable. The particular accuracy and care involved in the manufacture of the numerous individual parts required and in the assembly of this device lead to high manufacturing costs. The auxiliary device required to symmetrically guide the clamping jaws further increases manufacturing costs. and also increases the weight of the device which makes handling difficult.

A general object of the present invention is to overcome certain disadvantages of the prior art and to provide a clamp with which long plate-shaped and/or bar-shaped workpieces can be clamped, where both the first and second workpieces can be of plate-shaped design.

SUMMARY OF THE INVENTION

In accordance with this invention, a workpiece clamp is provided which is adapted to press a first extended plate-like or bar-shaped workpiece in its longitudinal direction against a bearing surface of another workpiece which may also be plate-like or bar-shaped.

This is accomplished by clamping jaws are mounted on a clamping jaw support and which extend, they project away from the plane of the support for clamping a first workpiece. This results in an open space, which is not restricted on the sides, for accommodating a second plate-shaped workpiece. Thus, a second plate-shaped workpiece can not only extend freely in the axial direction of the jaws but can also extend from one side to the other of the plane of the clamping jaw support.

Thus narrow edging strips and also large, plate-shaped workpieces can be clamped.

Further, in accordance with this invention, a workpiece clamp is provided which comprises a retaining frame, a chucking tool for generating a pressure force which can be transmitted to the bearing surface of a second workpiece, at least one counter-holding device consisting of a clamping jaw support with a U-shaped opening and two clamping jaws with spiral-shaped clamping surfaces pivot-mounted in stationary fashion on the clamping jaw support, which are positioned symmetrically opposite one another and mounted parallel to one another, such that the opening is located between the clamping jaws.

Further, in accordance with this invention, the clamping jaws are rotatably and tiltably mounted on bearing pins which permit large clamping forces to be generated even if the bearing pins only one side spread apart. Due to the tilting mounting of the clamping jaws on the bearing pins, the clamping surfaces can always position themselves accurately on the first workpiece and good transmission of the clamping force is assured.

The radial distance of the clamping jaws preferably displays a spiral-shaped profile of the kind that permits the clamping force of the clamping jaws to always be applied at the same angle A to workpieces of different thickness. The range of angles through which the clamping surface extends is divided into angular steps of equal size. The radial distance from the rotational axis to the clamping surface increases by the same amount with each angular step. Angle A is preferably small, in order to be able to achieve high clamping forces with a small angle A. However, it must not approach a value of 0° too closely, because the manufacturing tolerances and elastic deformations of the components could prevent the workpiece from being clamped tightly enough and cause it to slip through the clamping jaws.

Of course, the radial distance from the rotational axis to the clamping surface need not increase in equal angular steps and by the same amounts each time. The amounts can increase or decrease with each angular step. It is also possible to switch between an increasing and decreasing amount. This can be dependent on the combination of materials which make up the surfaces of the clamping jaws and the workpieces to be clamped, the two of which form a friction pairing.

The angular range of the clamping surfaces for clamping a workpiece, can be provided with limiting elements which restrict the rotation of the clamping jaw to this angular range.

Suitable pairs of clamping jaws can be provided in order to clamp different workpieces. They are simple to exchange.

The angular range required for a clamping surface is governed by the use of the workpiece clamp. If, for example, workpieces in a thickness range of roughly 1 mm to 40 mm are to be clamped, a clamping surface in an angular range of 280° is sufficient. If only workpieces of equal thickness are to be clamped, an angular range of roughly 20° is sufficient. In the latter case, the clamping jaw can be of very small design.

Due to the opening in the clamping jaw support in the region between the pivotal arrangements, long workpieces can extend through the clamping jaw support. This measure also makes it possible for the counterholding device to clamp long workpieces with an angled face. This expands the possible applications of the workpiece clamp.

The bearing pins are expediently of convex shape in order to enable tilting motion of the clamping jaws. The play between the clamping jaws and the bearing pins can be relatively great. This does not impair the function of the workpiece clamp and also drastically reduces the manufacturing costs.

A fixing element is advantageously provided on each of the bearing pins in order to prevent the axial shifting of the clamping jaws. This element can, for example, be an individual component which can be mounted in the region of the free ends of the bearing pins. These fixing elements can be easily removed for the simple procedure of switching the clamping jaws. Pairs of clamping jaws with differently shaped clamping surfaces or for different thickness ranges can be switched very easily.

In another configuration, the fixing element can be integrated into each clamping jaw. In the case of a clamping jaw made of plastic, the fixing element can, for example, be designed as a plastic clip integrally moulded in the bore hole of the clamping jaw which snaps into a groove of the bearing pin. In this way, the clamping jaws can be fixed in the axial direction when mounted on the bearing pins. This, however, does not restrict the rotational movement of the clamping jaw. This integrally moulded design further reduces the number of individual parts and the manufacturing costs.

Clamping jaws made of plastic are advantageous for clamping wood. Their strength can be enhanced by fibre-reinforced materials. Clamping jaws made of metal can also be used to tightly clamp metal parts.

In order to provide for simpler handling when positioning on a long workpiece, the clamping jaws can be subjected to a torque which returns them to a defined initial position. The torque acts in the direction of the decreasing radial distance between the clamping surface and the rotational axis. Any suitable means can be used to generate the torque. Each clamping jaw is preferably provided with a spring. The springs generate rotational motion in opposite directions, so that the rotational motion of the symmetrical clamping jaws is also symmetrical.

The return action of the clamping jaws makes it particularly easy to position the workpiece clamp, as it causes the clamping jaws to always rest against the surface of the workpiece. The frictional contact automatically produced in this way is required in order to generate a clamping force. If the clamping jaws did not spring back automatically, they would always have to be brought manually into frictional contact with the surface of the workpiece.

The ends of the clamping jaws facing the free ends of the bearing pins have a bevel. It is helpful to have bevels on the clamping jaws, particularly with a clamp clip configuration which is suitable for small workpiece thicknesses and provided with a return-action feature of the clamping jaws. When the workpiece clamp is not in use, the clamping jaws are always returned to their initial position, in which the points of the clamping surfaces farthest from the rotational axis move as close as possible to one another, leaving the smallest possible gap between the clamping jaws. Configurations are possible in which workpiece thicknesses of 1 mm and less can be clamped and whose clamping jaws touch in the initial position.

In order to be able to clamp a long workpiece with a round, prismatic or other cross-section not having any parallel lateral surfaces, the clamping surfaces of the clamping jaws are each advantageously provided with at least one groove in their circumferential direction which is adapted to the shape of the respective cross-section of the workpiece to be clamped.

For the sake of simplicity, the chucking tool can be provided with a screw spindle, which can be turned back and forth in a female thread of a clamp arm. The clamp arm can be mounted on the retaining frame in sliding fashion and such that it can be locked in any position. A commercial screw clamp can be used as the basis for this configuration. The conventional counterholding device of the screw clamp need only be replaced on the retaining frame by the counterholding device according to the invention.

In another configuration, a lever-type clamp with a claw which can move back and forth, can be mounted on the retaining frame as the chucking tool. Lever-type clamps of this kind are used on plate gripping tongs, which can thus serve as a basis for the clamp clip.

In a further configuration, a counterholding device is provided on each of two ends. A common chucking tool is mounted between these two counterholding devices, with which the counterholding devices can be moved towards and away from one another.

In order to clamp long mitred workpieces, at least two counterholding devices and one chucking tool can be provided. In this case, the retaining frame preferably has three clamp arms. The counterholding devices and the chucking tool are each mounted on a clamp arm. At least the clamp arms with the counterholding devices can advantageously pivot relative to one another. In this way, workpieces can be clamped at any mitred angle. In contrast to a conventional mitre screw clamp, the proposed clamp clip makes it possible to press the contact surfaces of the workpieces together firmly.

For the sake of simplicity, a junction element permits the clamp arms to pivot and to be locked in releasable fashion.

DESCRIPTION OF THE DRAWINGS

An example of the invention is illustrated in the drawing and described in detail based on the figures. The figures show the following.

BEST MODE FOR CARRYING OUT THE INVENTION

Figures 1, 2:
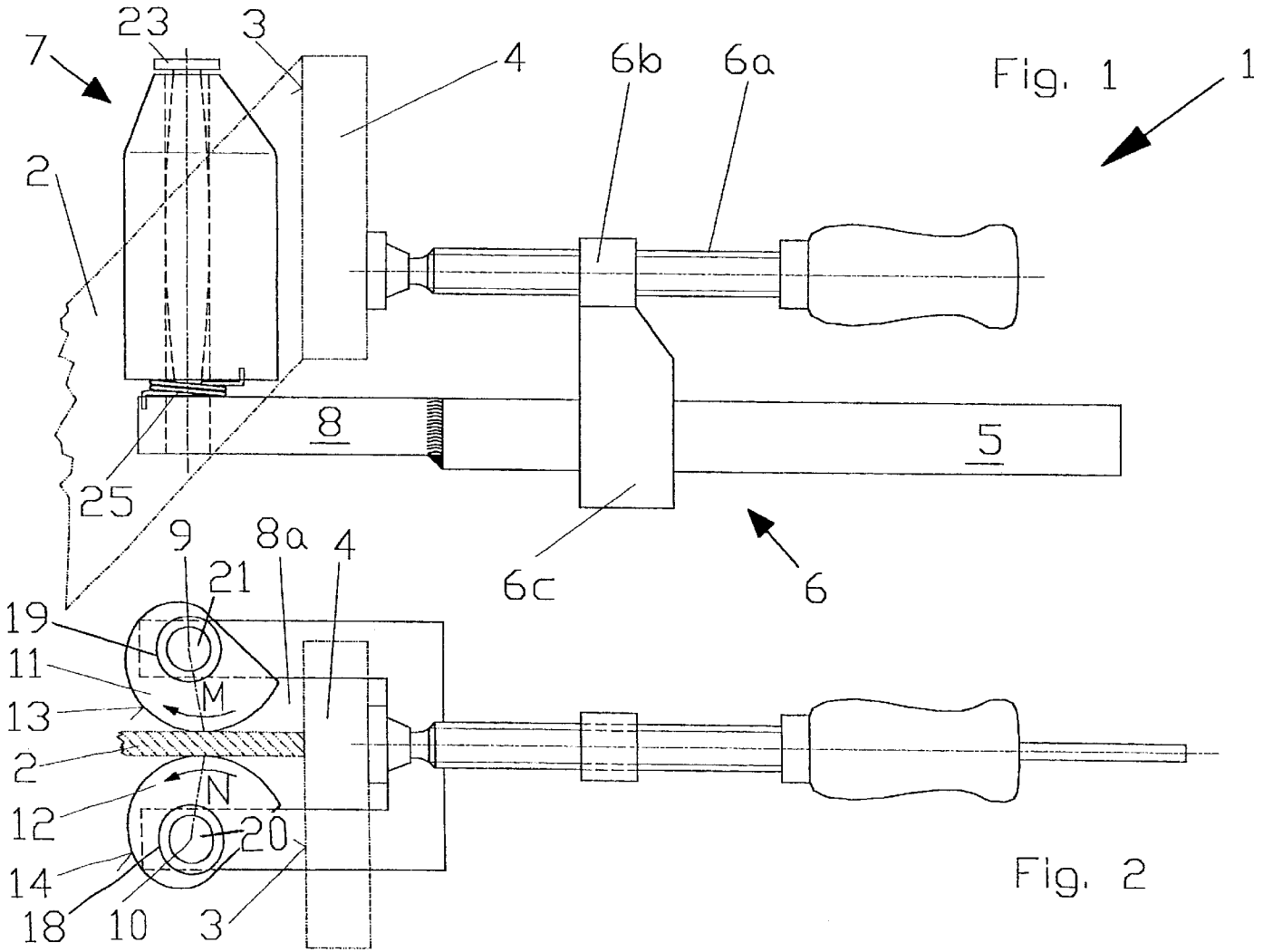
FIG. 1 A side view of a workpiece clamp based on a conventional screw clamp, FIG. 2 A top view of the workpiece clamp according to FIG. 1, FIG. 3 A top view of two clamping jaws in initial position, FIG. 4 A top view of two clamping jaws clamping a workpiece approximately 8.5 mm thick, FIG. 5 A top view of two clamping jaws clamping a workpiece approximately 25 mm thick, FIG. 6 A top view of two clamping jaws clamping a workpiece approximately 34 mm thick, FIG. 7 A top view of two clamping jaws clamping a workpiece approximately 40 mm thick, FIG. 8 A front view of a workpiece clamp in action with spread bearing pins and deflected clamping jaws, FIG. 9 A workpiece clamp with lever-type clamp, FIG. 10 A workpiece clamp with two counterholding devices and a common chucking tool, FIGS. 11 and 11A A front and top view of a workpiece clamp with grooved clamping jaws for clamping tubes, FIG. 12 A workpiece clamp made of plastic with a plastic clip as a fixing element, FIG. 13 A front view of the workpiece clamp with a cross-section of one clamping jaw, according to FIG. 14, FIG. 14 A partial top view of a workpiece clamp, FIG. 15 A top view of a simple configuration of the workpiece clamp with one clamping jaw, FIG. 16 A top view of a workpiece clamp with two counterholding devices on pivoting clamp arms for clamping mitred joints.
Figure 5:
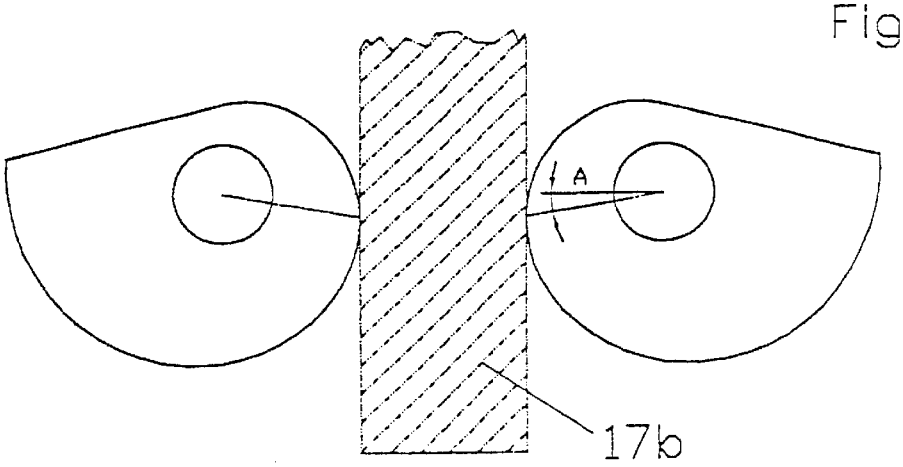
Figure 6:
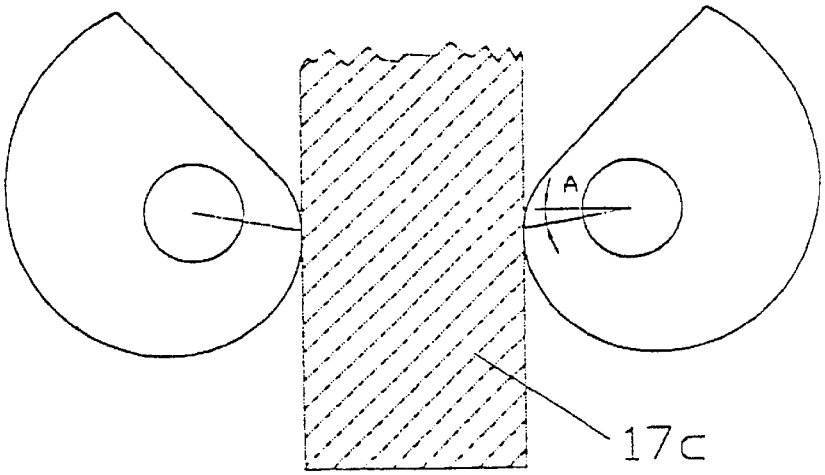
Figure 7:
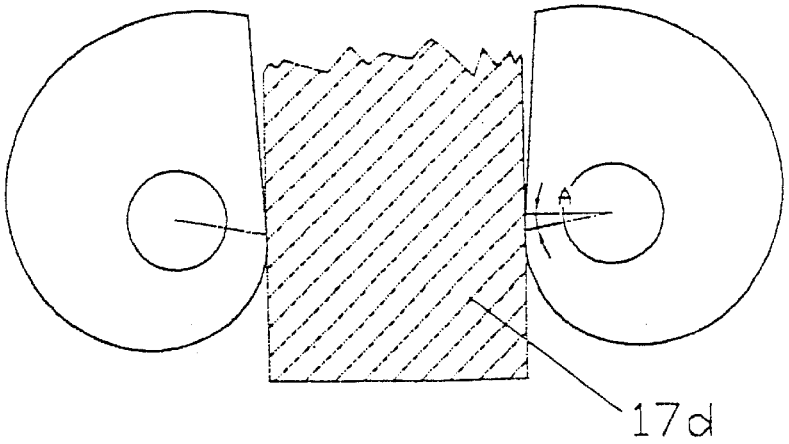

According to the drawing, workpiece clamp 1, for pressing long plate-shaped and/or bar-shaped workpieces 2 in their longitudinal direction against a bearing surface 3 of a second workpiece 4, comprises a retaining frame 5 provided with a chucking tool 6 which can move back and forth and generate the pressure force $F_A$ acting on bearing surface 3, and a counterholding device 7, with which a clamping force acting on second workpiece 4 can be transmitted.

The configuration of the workpiece clamp shown in FIGS. 1 and 2 is based on a commercial screw clamp. The conventional counterholder of a screw clamp has merely been replaced on retaining frame 5 by counterholding device 7 according to the invention. For the sake of simplicity, chucking tool 6 of screw spindle 6*a* of the screw clamp, which can be turned back and forth in female thread 6*b* of clamp arm 6*c* of the screw clamp. Clamp arm 6*c* can slide and be jammed tight in any position on retaining frame 5 of the screw clamp.

Counterholding device 7 has a clamping jaw support 8 with stationary pivotal arrangements 9 and 10 for each of two clamping jaws 11 and 12. Clamping jaws 11 and 12 have clamping surfaces 13 and 14, whose radial distance from rotational axes 15 and 16 of clamping jaws 11 and 12 increases continuously through at least one range of angles. Clamping jaws 11 and 12 are arranged symmetrically, their rotational axes 15 and 16 being parallel to one another.

In the area between pivotal arrangements 9 and 10, clamping jaw support 8 preferably has an opening 8*d*. Thus, it is essentially of U-shaped design. As shown in FIG. 1, long workpieces with an angled end face can extend through opening 8*d* of clamping jaw support 8.

FIG. 3 shows that, in the present configuration, the angular ranges through which clamping surfaces 13 and 14 extend are divided into several equal angular steps of 10°. The radial distance from rotational axis 15 or 16 to clamping surface 13 or 14 increases by the same amount with each angular step. As a result of this particular geometry of clamping jaws 11 and 12, clamping force $F_K$ can always be applied at the same angle A to workpieces 17*a*, 17*b*, 17*c* and 17*d* of different thicknesses, as shown in FIGS. 4, 5, 6, and 7. The present configurations of the clamp clip can clamp workpiece thicknesses ranging from roughly 1 mm to 40 mm. FIG. 4 also shows frictional force $F_R$, which can be transmitted by friction, and the perpendicular force $F_N$, which occur as a result of the pressure force $F_A$ generated by the chucking tool.

Clamping jaws 11 and 12 have bore holes 18 and 19 with which they are mounted on the free ends of bearing pins 20 and 21. In order to enable tilting motion of clamping jaws 11 and 12 on bearing pins 20 and 21, the latter are expediently of convex shape.

Figure 8:
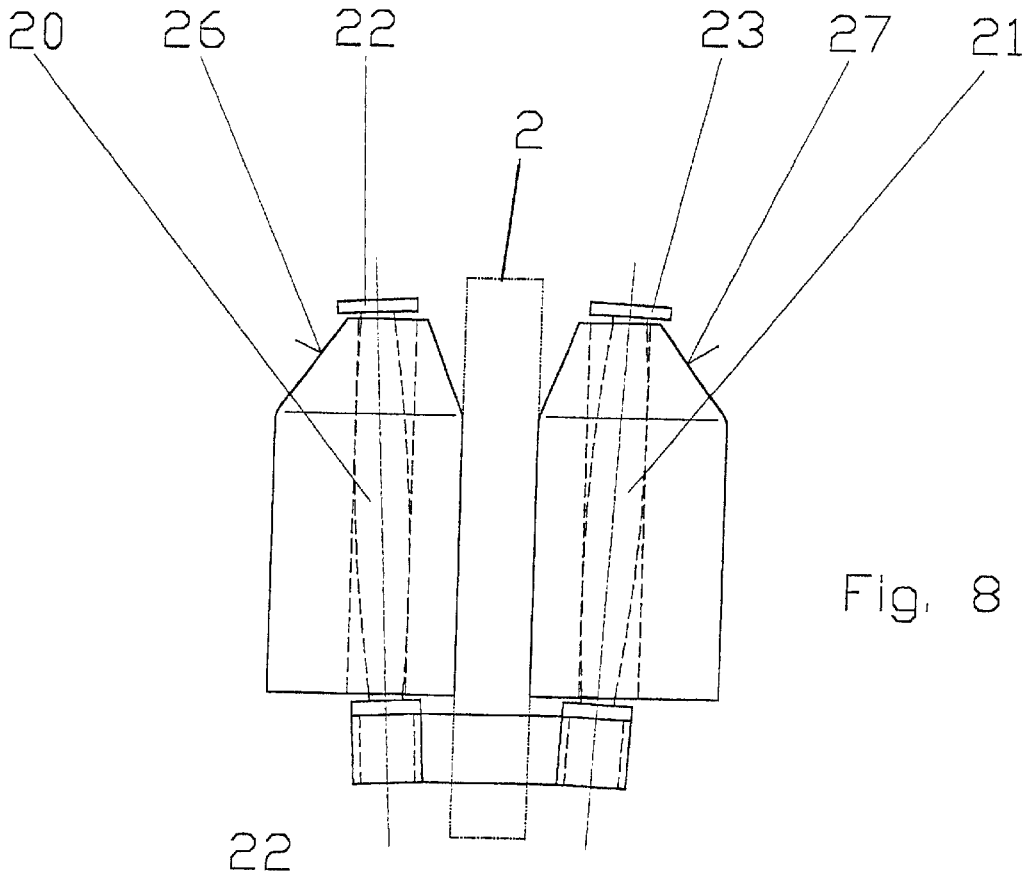

FIG. 8 shows a clamp clip in action which generates very high clamping forces. Its bearing pins 20 and 21 are spread apart, because clamping jaw support 8 and the bearing pins undergo elastic deformation. However, clamping jaws 11 and 12 are deflected from their coaxial position relative to the centre axis of bearing pins 20 and 21 and, despite the elastic deformation, thus lie exactly against the parallel lateral surfaces of long workpiece 2. This results in very good transmission of force to workpiece 2.

In order to prevent the axial shifting of clamping jaws 11 and 12 on bearing pins 20 and 21, a fixing element 22 and 23 is provided on each bearing pin 20 and 21. In the configuration illustrated in FIG. 1, fixing element 22 and 23 is an individual component mounted on the free ends of bearing pins 20 and 21.

In order to provide for simpler handling when positioning on a workpiece 2, clamping jaws 11 and 12 are subjected to a torque which returns them to a defined initial position. The torque acts in the direction of the decreasing radial distance between clamping surface 13 or 14 and rotational axis 15 or 16. In the configuration illustrated, the torque is generated by a spring 24 and 25 in each case. The springs used here are spiral springs. Springs 24 and 25 generate rotational motion in opposite directions, as indicated by arrows M and N in FIG. 2.

The face ends of clamping jaws 11 and 12 facing the free ends of bearing pins 20 and 21 each have a bevel 26 and 27. Bevels 26 and 27 serve to simplify the positioning of the clamp clip on a long workpiece.

Figure 11:
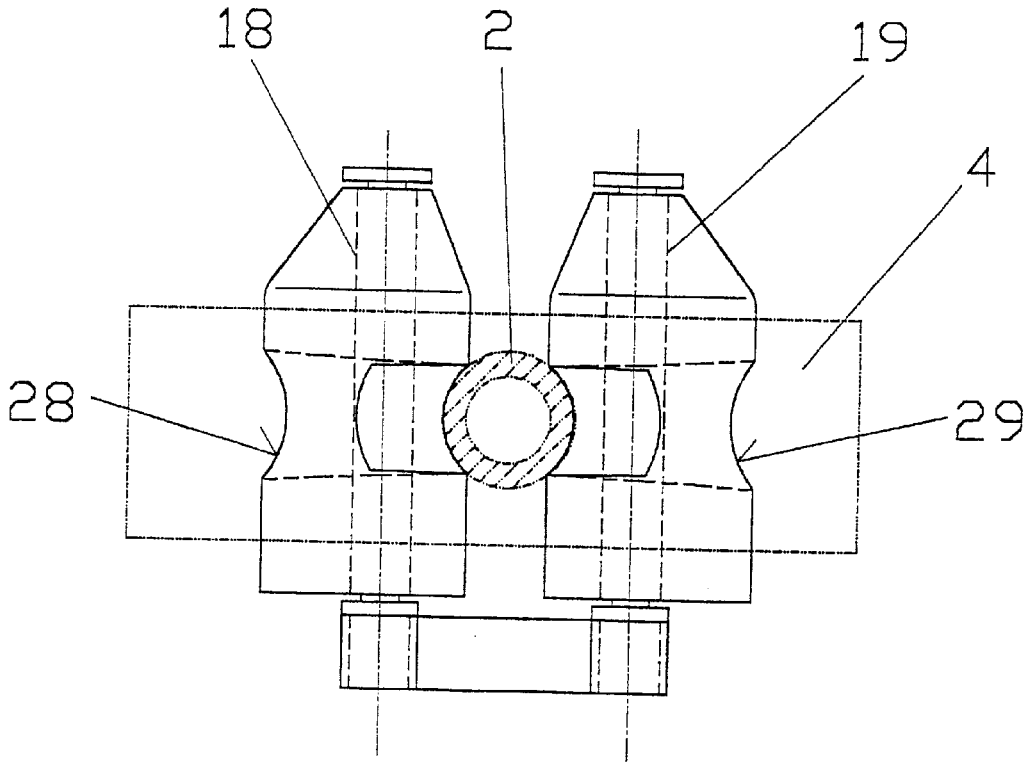
Figure 11A:
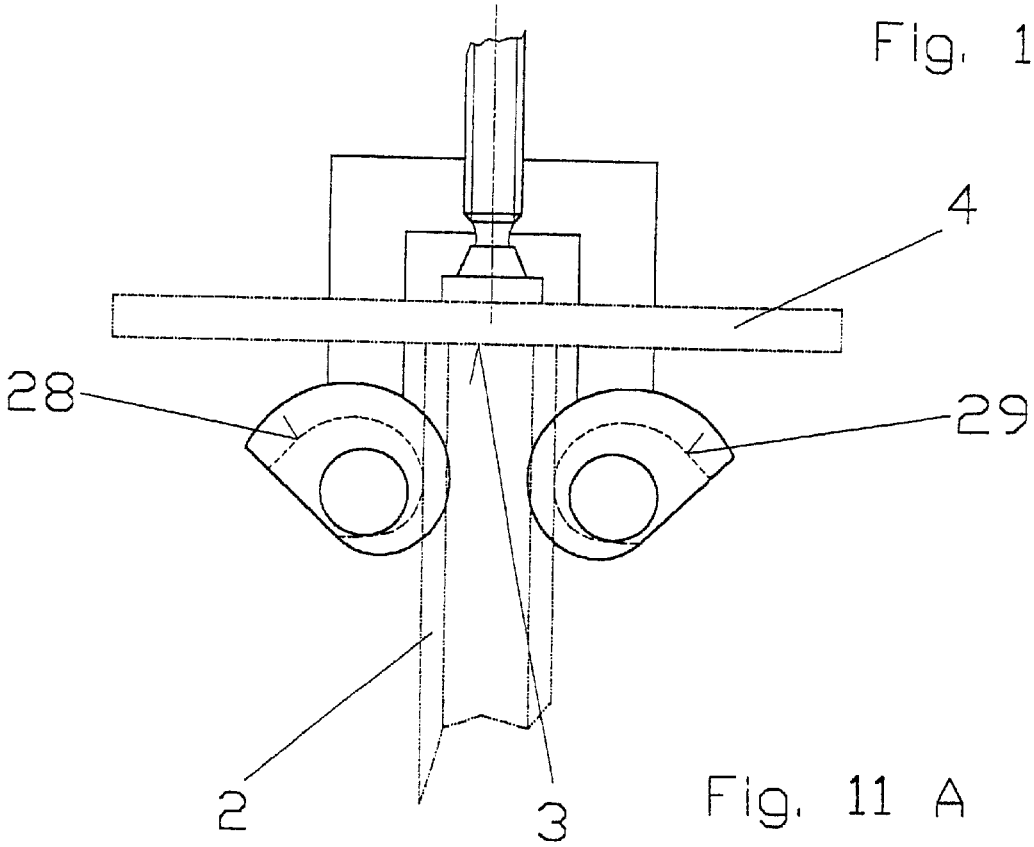

In the configuration illustrated in FIG. 11, clamping jaws 11 and 12 are each provided with at least one groove 28 and 29 in their circumferential direction which is adapted to the cross-section of cylindrical, tubular workpiece 2.

Figure 9:
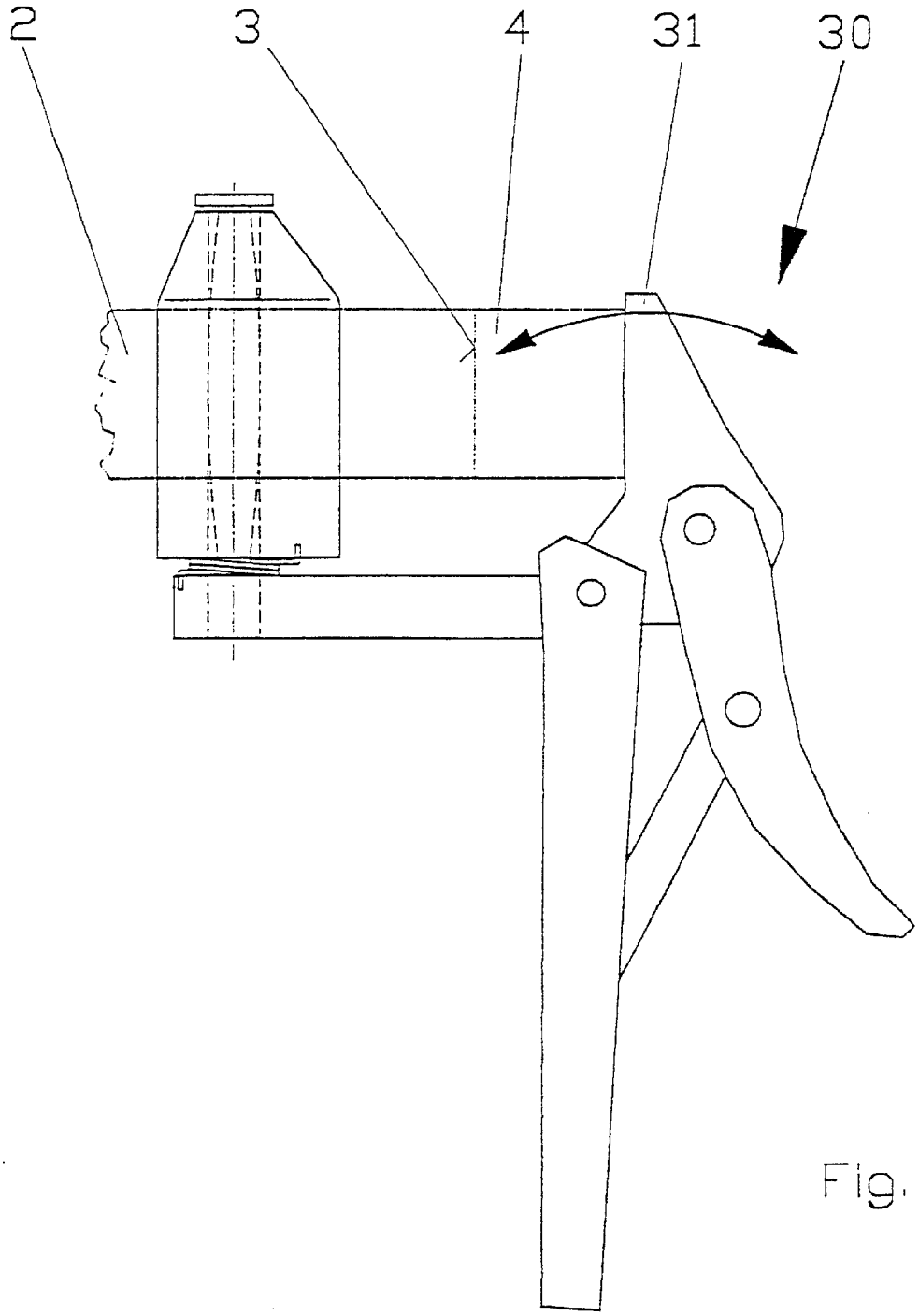

In the configuration illustrated in FIG. 9, a lever-type clamp 30 with a claw 31, which can move back and forth, is mounted on retaining frame 5 as chucking tool 6. Lever-type c lamps 30 of this kind are used on lockable plate gripping tongs which can grip several sheets. For the sake of simplicity, this configuration of the clamp clip is thus based on a gripper of this kind. The short distance claw 31 can move back and forth when operated, is adequate for providing sufficient rotation of clamping jaws 11 and 12, so that workpiece 2 can be clamped tightly.

Figure 10:
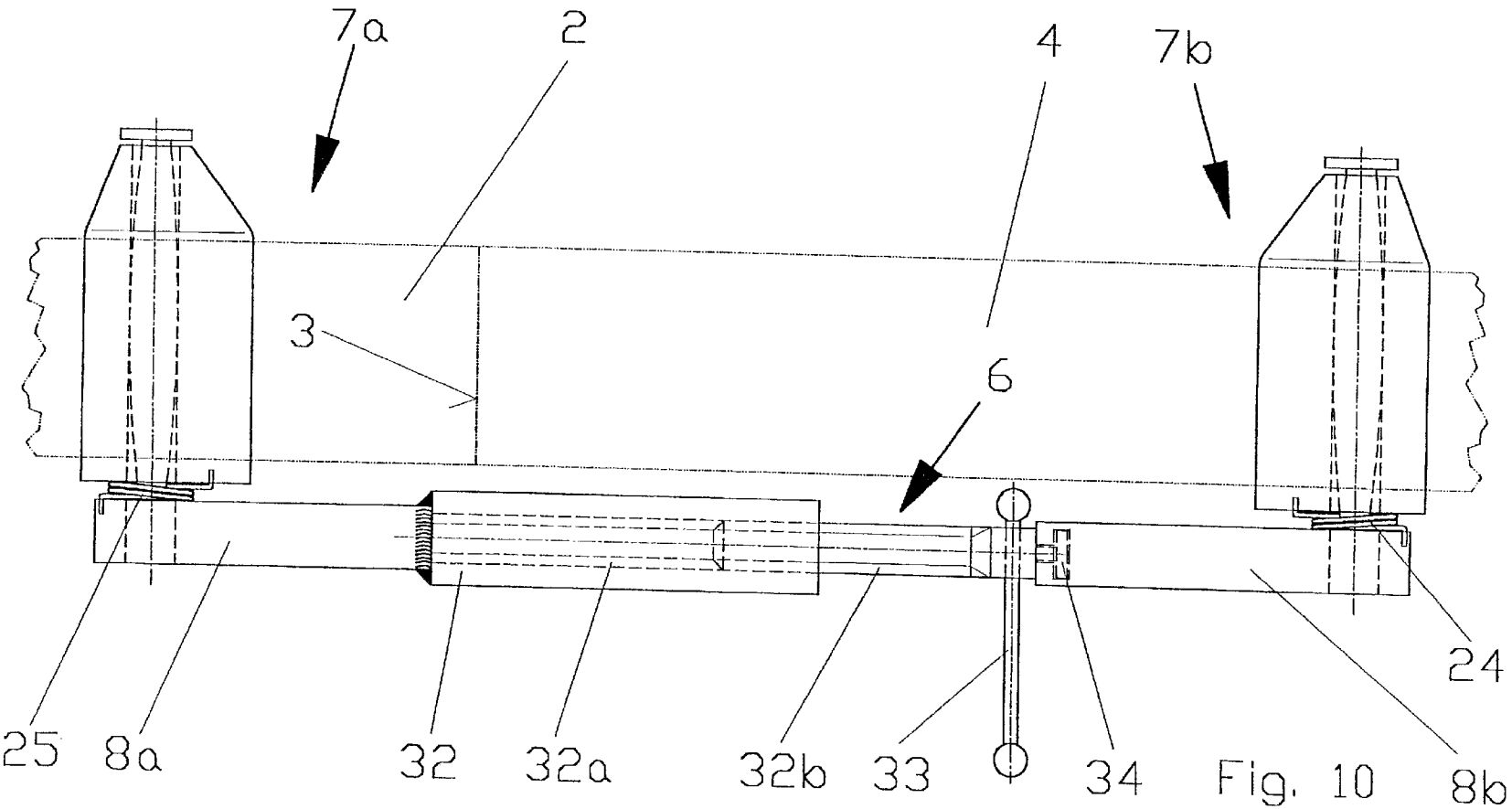

In the configuration according to FIG. 10, a counterholding device 7*a* and 7*b* is provided on each of the two ends of the clamp clip. A common chucking tool 6 is mounted between these two counterholding devices 7*a* and 7*b*, with which the counterholding devices can be moved towards and away from one another. Chucking tool 6 consists of a screw spindle and a chucking tube 32. Chucking tube 32 serves as retaining frame 5 and is provided with a female thread 32*a*, in which screw spindle 32*b* can be turned back and forth. A locking handle 33 or the like is provided in order to turn screw spindle 32*b*. Clamping jaw support 8*b* is connected in rotating fashion to screw spindle 32*b* via a feed catch 34, so that screw spindle 32*b* can turn without clamping jaw support 8*b* turning at the same time.

Figure 12:
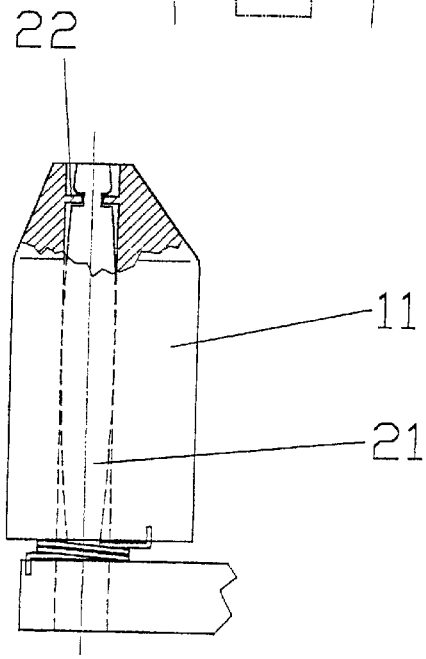

FIG. 12 shows an example of a clamping jaw 11 made of plastic, which is provided with an integrally moulded plastic clip 22. This clip fits in a groove of bearing pin 21 and thus prevents the axial shifting of workpiece clamping jaw 11 on bearing pin 21.

Figure 13:
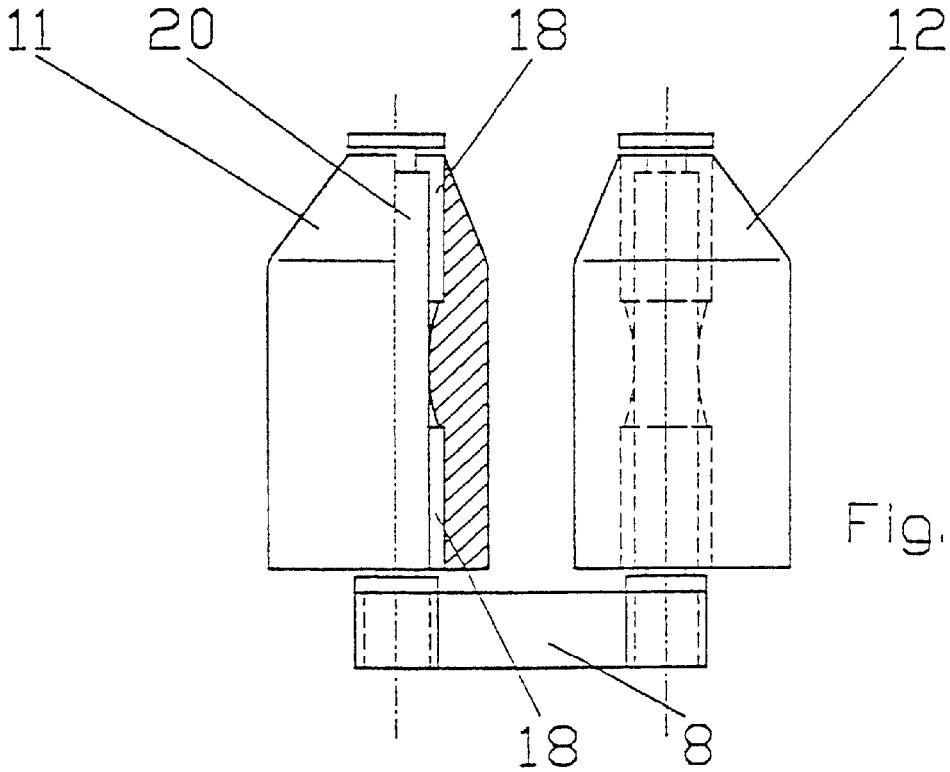
Figure 14:
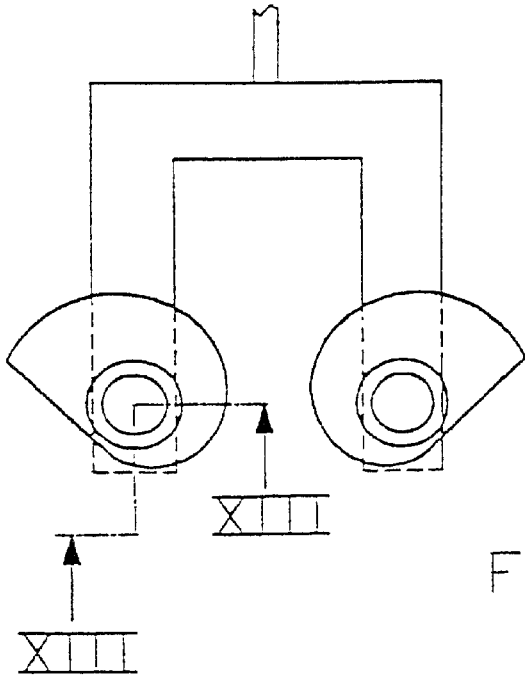

FIG. 13 shows a clamping jaw 11 with concave region 35 of bore hole 18. Thus, bearing pin 20 can simply be of cylindrical design. A clamping jaw 11 of this kind is very easy to shape in series production by suitable moulding or forming processes. Reworking is unnecessary. Due to its cylindrical form, bearing pin 20 can also be manufactured inexpensively as a metal piece without complex machining work.

Figure 15:
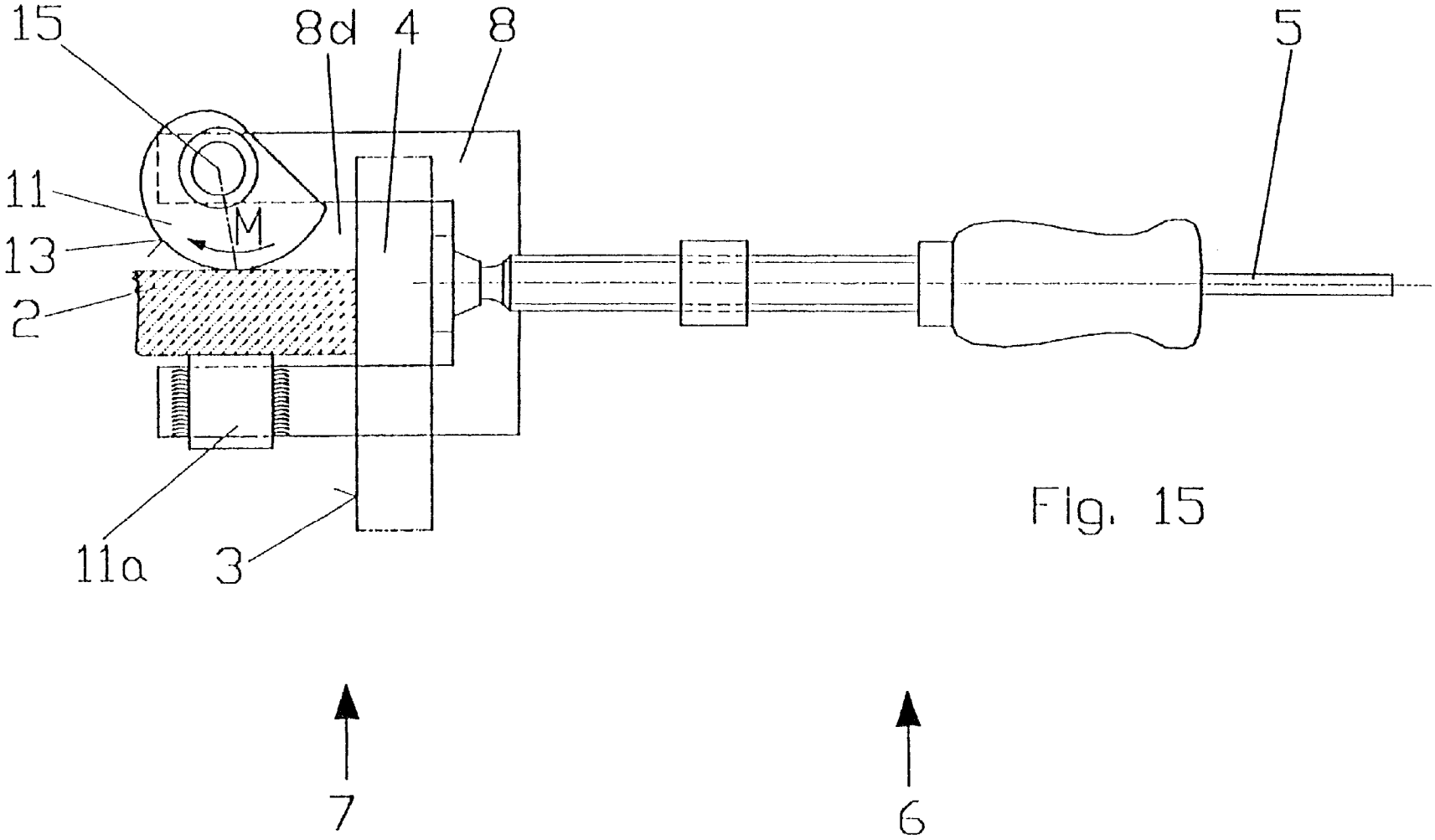

FIG. 15 shows a simple configuration of clamp clip 1, whose thrust bearing Ila consists of a simple counterstay, this being firmly mounted on clamping jaw support 8. In the present example, it is welded to clamping jaw support 8. Of course, it can also be mounted by way of a pin connection or other type of connection.

Figure 16:
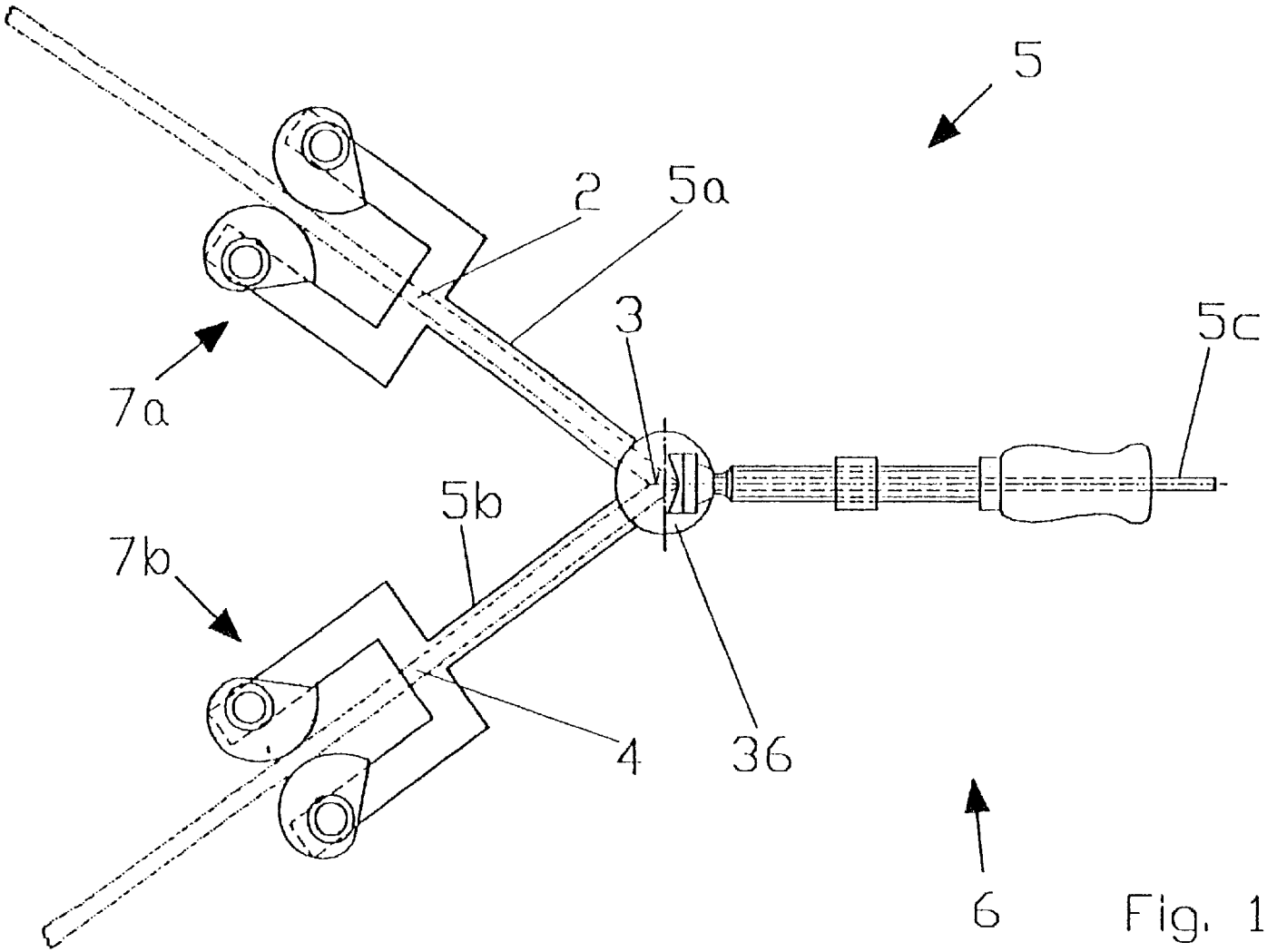

FIG. 16 shows a clamp clip for clamping mitred workpieces. It has two counterholding devices 7*a* and 7*b* and one chucking tool 6. Retaining frame 5 is equipped with three clamp arms 5*a*, 5*b* and 5*c*. Counterholding devices 7*a* and 7*b* and chucking tool 6 are each mounted on a clamp arm 5*a*, 5*b* and 5*c*. At least clamp arms 5*a* and 5*c* with counterholding devices 7*a* and 7*b* can advantageously pivot relative to one another. In this way, bearing surface 3 can be pressed against second workpiece 4 at any mitred angle. In contrast to a conventional mitre screw clamp, the proposed clamp clip makes it possible to press the contact surfaces of the workpieces together firmly. For the sake of simplicity, a junction element 36 permits the clamp arms to pivot and to be locked in releasable fashion. Chucking tool 6 consists of screw spindle 6*a* similar to a screw clamp, which can be turned back and forth in a female thread 6*b* of a clamp arm 6*c*. Clamp arm 6*c* can slide and be jammed tight in any position on clamp arm 5*c* of retaining frame 5. However, the configuration in FIG. 16 is in no way limited to a chucking tool similar to a screw clamp. Rather, any suitable chucking tool can be used.

Although the description of this invention is given with reference to a particular embodiment, it is not to be construed in a limiting sense. Many variations and modifications will now occur to those skilled in the art. For a definition of the invention, reference is made to the appended claims.

What is claimed is:

1. In a workpiece clamp for pressing a first workpiece (2) in its longitudinal direction against a bearing surface (3) of a second workpiece (4), said workpiece clamp being of the type comprising a support frame (5), a chucking tool (6) mounted on the support frame (5) for movement thereon for applying a force to the bearing surface (3) of the second workpiece (4), a counter-holding device (7) mounted on said frame and including a clamping jaw support (8), first and second clamping jaws (11,12) with spiral-shaped clamping surfaces (13,14), said clamping jaws being pivotally mounted on the clamping jaw support (8) and being positioned opposite one another, the improvement comprising:

said clamping jaw support (8) being of U-shape with two spaced apart support members, first and second pivot pins (20,21) mounted parallel to and laterally opposite each other on said first and second support members, respectively, said first and second clamping jaws (11, 12) being mounted for rotation on said first and second pivot pins, respectively, whereby said clamping jaws squeeze and hold the first workpiece therebetween when said chucking tool (6) is moved against said second workpiece to force the workpieces into engagement.

2. A workpiece clamp as defined in claim 1 wherein:

said clamping jaws (11,12) have rotational axes (15,16) and the range of angles through which the clamping surfaces (13,14) extend is divided into angular steps of equal size and the radial distance from the rotational axes (15,16) to the clamping surfaces (13,14) increases by the same amount with each angular step.

3. A workpiece clamp as defined in claim 1 wherein:

the bearing pins (20,21) are of convex shape to provide clearance for tilting motion of the clamping jaws (11, 12).

4. A workpiece clamp as defined in claim 1 wherein:

a fixing element (22,23) is provided on each of the bearing pins (20,21) to prevent axial shifting of the clamping jaws (11,12).

5. A workpiece clamp as defined in claim 4 wherein:

the fixing elements (22,23) are separate parts mounted adjacent the free ends of the bearing pins (20,21).

6. A workpiece clamp as defined in claim 1 wherein:

a fixing element (22,23) is provided on each of the clamping jaws (11,12) and is integral therewith to prevent axial shifting of the clamping jaws (11,12).

7. A workpiece clamp as defined in claim 1 including:

means operatively connected with the clamping jaws (11,12) for applying torque which urges them toward a predetermined initial position.

8. A workpiece clamp as defined in claim 7 wherein:

said torque urges said jaws in the closing direction.

9. A workpiece clamp as defined in claim 8 wherein:

the clamping jaws (11,12) are provided with at least one spring (24,25) to generate said torque.

10. A workpiece clamp as defined in claim 1 wherein:

the end of each clamping jaws (11,12) facing the free end of its bearing pin (20,21) has a bevel (26,27).

11. A workpiece clamp as defined in claim 1 wherein:

the clamping surfaces (13,14) of the clamping jaws (11, 12) are provided with a groove (28,29) having a non-rectangular cross-section for engagement with a workpiece (2) having non-parallel lateral surfaces to be clamped.

12. A workpiece clamp as defined in claim 1 wherein:

said chucking tool (6) comprises a clamp arm (6*c*) mounted on said support frame (5) and a screw spindle (6*a*) in threaded engagement with said clamp arm.

13. A workpiece clamp as defined in claim 12 wherein:

said clamp arm (6*c*) is adjustably mounted on said support frame (5).

14. A workpiece clamp as defined in claim 1 wherein:

said chucking tool (6) comprises a clamping claw (31) having an actuating lever means mounted on the support frame (5).

15. A workpiece clamp as defined in claim 1 wherein:

said chucking tool (6) comprises a chucking tube (32) and a spindle (32*b*), said tube and said spindle being in threaded engagement, and a second counter-holding device (7*a*,7*b*) is supported on one of said tube (37) and spindle (32*a*) and the first-mentioned counter-holding device (7*a*,7*b*) is supported on the other of said tube (37) and spindle (32*a*).

16. A workpiece clamp as defined in claim 1 wherein:

said support frame (5) has three frame arms (5*a*,5*b*,5*c*) in a Y-configuration, said first mentioned counterholding device (7*a*) being mounted on first one of said arms (5*a*), and a second counter holding devices (7*b*) mounted on a second one of said arms (5*b*), said chucking tool (6) being mounted on a third one of said arms (5*c*), and wherein said arms (5*a*,5*b*) are adjustably pivotable relative to each other.

* * * * *